United States Patent [19]

van Vlimmeren

[11] Patent Number: 4,529,293

[45] Date of Patent: Jul. 16, 1985

[54] ELECTROPHOTOGRAPHIC COPYING PROCESS AND MACHINE

[75] Inventor: Quirinus A. G. van Vlimmeren, Veldhoven, Netherlands

[73] Assignee: Océ-Nederland B.V., Venlo, Netherlands

[21] Appl. No.: 467,739

[22] Filed: Feb. 18, 1983

[30] Foreign Application Priority Data

Mar. 2, 1982 [NL] Netherlands ..... 8200825

[51] Int. Cl.³ ..... G03G 15/08

[52] U.S. Cl. ..... 355/14 D; 355/14 E; 430/120

[58] Field of Search ..... 355/3 DD, 14 D, 14 E; 430/120

[56] References Cited

U.S. PATENT DOCUMENTS

| | | | |
|---|---|---|---|
| 2,956,487 | 10/1960 | Giaimo | 355/14 D |
| 3,346,475 | 10/1967 | Matkan et al. | 204/181 |
| 3,805,739 | 4/1974 | Feldeisen et al. | 355/14 D X |
| 4,102,305 | 7/1978 | Scharz | 118/651 |
| 4,256,401 | 3/1981 | Fujimura et al. | 355/14 D X |
| 4,265,197 | 5/1981 | Toyono et al. | 118/657 |

FOREIGN PATENT DOCUMENTS 1458766 12/1976 United Kingdom .

OTHER PUBLICATIONS

Patent Abstracts of Japan, vol. 6, No. 13, (Jan. 26, 1982), p-99, [891]; No. 8, (Jan. 19, 1982), p-98, [886].

*Primary Examiner*—Fred L. Braun

*Attorney, Agent, or Firm*—Albert C. Johnston

[57] ABSTRACT

Electrophotographic copying by use of a machine in which a charge image is developed by the application of electrically conductive marking (toner) particles can be carried out so as to produce well imaged copies of low-contrast originals that contain weak image information by effecting the copying under conditions which cause the charge image to be developed with a grayish background of sparsely attracted particles and, during the developement, applying between an electrode of the developing device and the photoconductive element an a.c. voltage having a frequency of between 1 and 7 kHz and an amplitude of at least 50 volts, thereby rendering the background homogeneous in tone. In positive working processes, illumination that underexposes the element is used and only the a.c. voltage need be applied in development. In negative working processes, illumination that over-exposes the element is used and in development the a.c. voltage is superimposed onto a d.c. voltage applied between the developing electrode and the element. Copying machines of the invention are provided with control systems which in one setting thereof will establish conditions of exposure and development suited for normal copying of well imaged originals, to produce images with background substantially free of marking particles, and in another setting will establish the conditions suited for producing images of low-contrast originals with homogeneous grayish backgrounds.

13 Claims, 2 Drawing Figures

ELECTROPHOTOGRAPHIC COPYING PROCESS AND MACHINE

Figure 1:
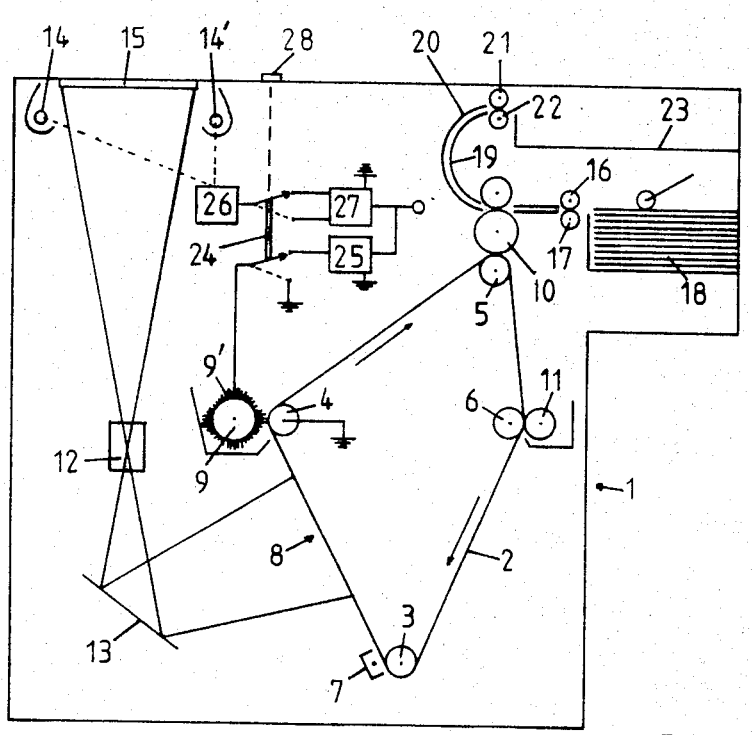

This invention relates to an electrophotographic copying process, and a copying machine, in which use is made of electrically conductive marking particles, or conductive toner powder, for reproducing originals that contain low-contrast image information, i.e., weakly imaged originals, as well as for reproducing well imaged originals which contain only high-contrast information.

Originals that contain only high-contrast information, e.g. printed information and information written or drawn in ink, can generally be copied satisfactorily by known electrophotographic copying techniques making use of electrically conductive marking particles. Low-contrast information, however, such as information on pencil drawings, microfilms of pencil drawings and carbon copies of typed texts, is often reproduced unsatisfactorily, or not at all, on the copy obtained when the amount of light used for image-wise exposure of the photoconductive imaging element in the copying machine is set to produce a charge image, and hence a copy, having a background on which no marking (toner) particles are deposited. It therefore is conventional in various copying techniques to improve the information reproduction from originals containing low-contrast information by effecting the imagewise exposure with a quantity of light that causes the low-contrast information to be reproduced with increased density. To this end, under-exposure is used in positive-positive copying processes, and over-exposure in negative-positive copying processes.

The low-contrast information is reproduced with higher contrast by such under-exposure or such over-exposure, respectively, since use is made in each case of a steeper portion of the exposure characteristic of the photosensitive material used in the photoconductive imaging element. In each such case, a relatively small quantity of the marking particles is deposited on the background and it thus acquires a grayish tone, which may be gray or light colored depending upon the color of the developer. This grayish background is generally considered acceptable in copies of weakly imaged originals.

When copying is effected in an electrophotographic copying machine making use of conductive marking particles having a resistivity of up to about $10^{13}$ ohm.cm, the reproduction of information from an original containing low-contrast information can also be improved by adjusting the potential of an electrode of the developing device to a value that promotes the deposition of marking particles on the background areas of the charge image formed on the photoconductive element. In the case of positive-positive processes a lowered potential serves this purpose, and in negative-positive processes a raised potential. Here again the weak information of an original is reproduced with greater density and the contrast increases because a steeper portion of the developing characteristic is used.

A considerable disadvantage, however, generally must be suffered when copies are produced with a grayish background by adjusting the exposure of the photoconductive element or the potential of the developing electrode in an electrophotographic copying machine in which development is effected with electrically conductive marking particles. This disadvantage is that the background does not always become homogeneous. Electrically conductive marking particles are very sensitive to uneven charge distributions on the photoconductive element and react thereto by irregular deposition which is most striking in portions of the image that are sparsely covered by marking particles, and hence also in the grayish background.

The principal object of the present invention is to obviate the problem of the irregular background, and to this end to provide an electrophotographic copying process and a machine for carrying it out in which use is made of electrically conductive marking particles for developing the images yet good copies can be produced of documents bearing weak information.

The electrophotographic copying process and machine of the present invention are based on the discovery that the problem of background irregularity which exists in the known techniques employing electrically conductive marking particles for the image development, when copies of low-contrast originals are produced under conditions causing formation of a grayish image background, can be overcome by applying between the developing device and the photoconductive imaging element of the copying machine, during development of the charge image resulting from exposure of that element to the light image of a low-contrast original, an a.c. voltage having a frequency of between 1 and 7 kHz and a peak-to-peak amplitude of at least 50 volts.

It has been found that by combining image forming conditions that produce a grayish background with an appropriate a.c. voltage between the developing electrode and the photoconductive element a very uniform, grayish background is obtained on which low-contrast information is readily visible. The a.c. voltage in these conditions has an evening effect on the background development if the frequency is set to a value of between 1 and 7 kHz. The evening effect increases with decreases of the frequency from 7 to 1 kHz, but there is also an increase in the grain structure in the background. A frequency of between 3 and 5 kHz has been found most advantageous, as it provides a good evening effect while the grain structure is still kept very fine.

The amplitude required for the a.c. voltage to be employed depends on the frequency selected, the resistivity of the marking particles, and the distance between the developing electrode and the photoconductive element. Since the amplitude selection is substantially independent of the associated optimum combinations of resistivity and electrode spacing, it is influenced primarily by the frequency. By way of example, with a frequency of 1 kHz, a minimum peak-to-peak amplitude of 50 volts is usually required for a favorable effect, while at 6 kHz the minimum peak-to-peak value is generally 175 volts. The optimum effect is generally obtained at a peak-to-peak voltage of between 175 and 250 volts. Any further increase in the amplitude of the a.c. voltage generally does not provide further improvement, although it does not provide any worse result either.

The stated values of amplitude relate to the use of marking particles having a resistivity of $10^7$ ohm.cm, and of a spacing of 1.7 mm between the developing electrode and the photoconductive element. The optimum electrode spacing and optimum amplitude of the a.c. voltage to be used when employing marking particles having a different resistivity will be readily determinable in known manner by persons skilled in the art.

The background tone evening effect of the a.c. voltage decreases with increasing resistivity when marking particles having higher resistivity are used, but in such cases the a.c. voltage is required to eliminate only a minor inequality because the sensitivity of the marking particles to charge inequalities decreases with increasing resistivity. No further evenng effect occurs if the marking particles used have a resistivity higher than $10^{13}$ ohm.cm, but in such a case the problem of the irregular background is practically non-existent.

In a copying machine for carrying out the present invention, the a.c. voltage is not usable for a setting of the image forming conditions by which the charge image will be developed with a background substantially free of the marking particles. Use of the a.c. voltage for such copying conditions would cause an image with a grayish background of reduced contrast to be produced by the oonductive marking particles, along with a deterioration in the information reproduction of the image. Thus, instead of the improved information reproduction achieved in the case of the image forming conditions to be used for a low-contrast original, in which a grayish background is considered acceptable, there is in the other case a deterioration of reproduction with the additional disadvantage of a grayish background.

Copying machines comprising developing devices which include an electrode for applying an a.c. voltage between the developing device and a photoconductive element are known per se, as may be seen, for instance, in U.S. Pat. Nos. 3,346,475, 4,102,305 and 4,265,197 and UK Patent Specification No. 1,458,766.

Figure 2:
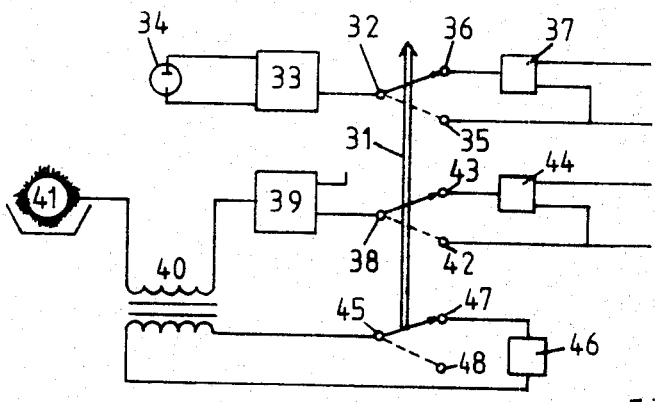

The principles and ways of practicing the invention will be further evident from the following description and the accompanying schematic drawings of illustrative embodiments of the invention. In the drawings:

FIG. 1 is a diagrammatic cross-sectional view of an electrophotographic copying machine for carrying out the invention by producing a positive copy from a positive original by developing the charged areas of the image field; and FIG. 2 is a block diagram of a control circuit with which copying of a negative original can be effected by developing the discharged areas of the image field.

The copying machine 1 illustrated in FIG. 1 comprises an endless photoconductive belt 2 running about four rollers 3, 4, 5, 6 in the direction indicated by the arrows. The belt 2 in so travelling passes successively the following processing stations disposed about its path:

a charging station 7 comprising a corona for charging the photoconductive belt;

an exposure station 8 for forming a charge image by imagewise ex- posure;

a developing station comprising a magnetic brush developing device 9 having a sleeve rotating about magnets, for applying magnetizable electrically conductive one-component developer powder to the charge image, a transfer station comprising a transfer and fixing device 10, in which the developed powder image is transferred onto an intermediate carrier and then is transferred from the intermediate carrier to a sheet of copy paper and fixed thereon; and a cleaning station comprising a device 11 for cleaning residual developer particles from the photoconductive element.

The imagewise exposure of the photoconductive belt element at station 8 is effected by a light image of an original lying on an exposure platen 15, the original being illuminated by flashlamps 14 and 14' and the resultant light image being projected by a lens 12 and a mirror 13 onto the belt 2 at the exposure location 8. The sheet of copy paper is transported by two transport rollers 16 and 17 from a stock tray 18 to the transfer and fixing device 10, and the copy leaving the transfer and fixing device 10 is delivered via guide plates 19 and 20 and two transport rollers 21 and 22 and deposited in a receiving tray 23.

The rear side of the photoconductive belt 2 is grounded via a roller 4 at the developing station. This roller is disposed opposite the developing device 9 and in contact with the rear side of the photoconductive belt. The sleeve of the developing device 9 is made electrically conductive to serve as an electrode and is connected to a master contact of a two-pole selector switch 24 by which, depending on the position of the selector switch, the sleeve either is grounded or is connected with an a.c. voltage generator 25 that generates an a.c. voltage of 250 volts(peak-to-peak) at a frequency of 4 kHz.

The flashlamps 14 and 14' are connected with a power supply unit 26 which in turn is connected to the other master contact of the two-pole selector switch 24. That contact, depending upon the position of the selector switch, is connected to either a high voltage or a low voltage output of a voltage source 27.

Upon imagewise exposure of the photoconductive element under standard conditions, such as for copying a high-contrast original to obtain an image having a background substantially free of marking (developer) particles, the selector switch 24 of the machine control system is set in the position shown by broken lines in FIG. 1. The sleeve of the developing device then has zero potential and the power supply unit 26 for the flashlamps then is connected to the high voltage output of source 27 for a normal exposure which produces a copy without any marking particles in the background of the image.

For copying originals with weak image information, the selector switch 24 is moved to the position in which its master contacts are connected as indicated by arrows. The selector switch is moved, for instance, by means of a knob 28 at the top surface of the copying machine. In that setting of the control system, as a result of the power supply unit for the flashlamps being connected to the lower voltage output of source 27, the photoconductive element receives less light upon exposure of an original; also, the sleeve electrode of the developing device 9 is connected to the a.c. voltage source 25, as a result of which an a.c. field at a frequency of 4 kHz and a peak-to-peak amplitude of 250 volts is applied between the developing device and the photoconductive element. In this setting of the system, an image of a low-contrast original is produced which is developed well in the reproducing image portions that remain charged after the imagewise exposure, and in which the background areas have a satisfactory homogeneous grayish tone.

The control circuit illustrated in FIG. 2 is suitable for use in an electrophotographic copying machine adapted for copying negative originals by use of a developing potential which enables development of the discharged areas of the charged photoconductive element by the application of electrically conductive marking particles.

The copying machine to be used with this circuit may in other respects be like that illustrated in FIG. 1.

The circuit of FIG. 2 comprises a three-pole selector switch 31, a master contact 32 of which is connected to a power supply unit 33 for at least one flashlamp 34 that will illuminate an original in the copying machine. In a first position of switch 31, the master contact 32 connects unit 33 with a contact 35 directly connected to a voltage source (not shown); and in a second position of switch 31 contact 32 connects unit 33 with a switch contact 36 which is connected to the same voltage source via a voltage adding circuit 37.

A second master contact 38 of selector switch 31 is connected to an adjustable d.c. voltage source 39, the output of which is connected, via the secondary winding of a transformer 40, to a rotatable sleeve forming the developing electrode of a magnetic brush developing device 41 supplied with magnetizable electrically conductive one-component developer powder for developing charge images in the copying machine. The d.c. voltage source 39 is provided with two inputs for controlling its output voltage. One of the inputs is connected to a capacitative measuring cell (not shown) by means of which the charge state of the photoconductive element in the copying machine is measured. The other input is connected to the second master contact 38, which in the first position of selector switch 31 connects the d.c. voltage source 39 with a switch contact 42 that is connected directly to a voltage source (not shown), which source in the second position of the selector switch is connected with the d.c. voltage source 39 via a switch contact 43 and a voltage adding circuit 44.

A third master contact 45 of selector switch 31 is connected to one end of the primary winding of the transformer 40. The other end of the primary winding is connected directly to one terminal of an a.c. voltage generator 46 that will generate an a.c. voltage, for instance, of 250 volts (peak-to-peak value) at a frequency of 3 kHz. The second terminal of the a.c. voltage generator is connected to a switch contact 47 through which the master contact 45 conducts the a.c. voltage to the primary winding of transformer 40 when the selector switch 31 is in its second position. The second contact 48 associated with master contact 45 is left inactive.

When the selector switch 31 is in its first position as indicated by broken lines from the master contacts 32, 38 and 45, the lamp 34 is ready for use for normal exposure of a photoconductive element in the copying machine; the electrode of the developing device 41 carries a d.c. voltage equal to the highest potential measured in the charge image by the capacitative measuring cell, thus counteracting the negative charge of the charge image; and the a.c. voltage source 46 is not connected. The setting of the control system to these conditions adapts the machine for copying high-contrast originals with the development of images substantially free of marking particles in their backgrounds.

When the selector switch 31 is placed in its second position as indicated by the arrows extending from the master contacts, the a.c. voltage of generator 46 is superimposed on the d.c. voltage supplied via transformer 40 to the developing electrode. Also, the lamp 34 upon ignition is energized at a higher voltage so that it gives, for instance, 30% more light and over-exposes the charged photoconductive element. Further, a higher control voltage is also applied to the adjustable voltage source 39 via the master contact 38 of the selector switch, so that the d.c. voltage on the developing electrode is increased, for instance by 20%. The conditions established by this setting of the control system adapt the machine for copying low-contrast originals with the development of images having satisfactory homogeneous backgrounds of grayish tone.

In alternative embodiments of the control circuit for a copying machine adapted for negative-positive image reproduction, the switching elements of a selector switch corresponding to switch 31 may be electronic instead of mechanical. For example, they may be in the form of relays or triacs coupled via a microcomputer. Another practicable alternative is to supply the voltage for controlling the lamp intensity, as at contact 35, via an automatic exposure control system that includes a cell for measuring the amount of light required for exposure of the originals to be copied. For originals that require over-exposure the measured amount of light can be corrected by connecting a voltage adding circuit. Similar alternatives may of course be applied to embodiments of the invention such as that illustrated in FIG. 1.

What is claimed is:

1. In an electrophotographic copying process in which a photoconductive imaging element is charged electrostatically and then is exposed to a light image formed by illumination of an original and the resultant charge image is developed by the attraction thereto of electrically conductive marking particles from a developing device comprising a developing electrode, the improvement for copying an original of low image contrast which comprises in combination:

employing for development of the charge image resulting from exposure of said element to the light image of a low-contrast original electrically conductive marking particles having a resistivity of less than $10^{13}$ ohm.cm;

effecting said exposure and said development under conditions which enhance the density of development of the desired image portions while causing their background to attract such particles sufficiently to become grayish in tone; and during such development applying between said electrode of the developing device and said element an a.c. voltage having a frequency of between 1 and 7 kHz and a peak-to-peak amplitude of at least 50 volts, thereby assuring homogeneity of said background tone.

2. A process according to claim 1, said a.c. voltage having a frequency of between about 3 and about 5 kHz.

3. A process according to claim 1, said marking particles having a resistivity of the order of about $10^7$ ohm.cm and said a.c. voltage having a frequency of between about 3 and about 5 kHz and a peak-to-peak amplitude of between about 175 and about 250 volts.

4. A process according to claim 1, wherein said resultant charge image is developed by the attraction to the portions thereof that remain charged of said electrically conductive marking particles from a developing device of which the developing electrode is grounded, said exposure being effected with a light image of the original that leaves said background charged sufficiently to attract said marking particles sparsely.

5. A process according to claim 4, said marking particles having a resistivity of the order of about $10^7$ ohm.cm and said a.c. voltage having a frequency of between 3 and about 5 kHz and a peak-to-peak amplitude of between about 175 and about 250 volts.

6. A process according to claim 1, wherein said resultant charge image is developed by the attraction of said electrically conductive marking particles to the discharged portions of said charge image by applying between said developing electrode and said element a d.c. voltage sufficient to counteract the charge of said charge image, said exposure being effected with a light image of the original that is stronger than required for keeping said background substantially free of marking particles, ahd said a.c. voltage being superimposed on said d.c. voltage.

7. A process according to claim 6, said marking particles having a resistivity of the order of about $10^7$ ohm.cm and said a.c. voltage having a frequency of between about 3 and about 5 kHz and a peak-to-peak amplitude of between about 175 and about 250 volts.

8. In an electrophotographic copying machine including a photoconductive imaging element, means for electrostatically charging said element, means for exposing the charged element to a light image formed by illumination of an original, thus forming a charge image composed of image portions and background areas, and means for developing the charge image including a developing device for applying electrically conductive marking particles to said element so that such particles are attracted to said image portions, said device comprising an electrode to apply a potential between it and said element, the improvement for copying originals of low image contrast which comprises, in combination with a said developing device supplied with electrically conductive marking particles having a resistivity of less than $10^{13}$ ohm.cm, control means for effecting said exposing and said developing under conditions which enhance the density of development of said image portions of the charge image formed from a low-contrast original while causing the background areas thereof to attract such particles sufficiently to become grayish in tone, and means for applying between said electrode of the developing device and said element during said development an a.c. voltage having a frequency of between 1 and 7 kHz and a peak-to-peak amplitude of at least 50 volts, whereby homogeneity of said background tone is assured.

9. An electrophotographic copying machine according to claim 8, said voltage applying means being operative to apply between said electrode and said element an a.c. voltage having a frequency of between about 3 and about 5 kHz and a peak-to-peak amplitude of between about 175 and about 250 volts.

10. An electrophotographic copying machine according to claim 8, and wherein said control means includes means operable to effect said exposing with a light image of the original that is stronger than required for keeping said background areas substantially free of said marking particles and means operable during said development for maintaining between said electrode and said element a d.c. voltage sufficient to counteract the charge of said charge image, and for superimposing said a.c. voltage on said d.c. voltage.

11. In an electrophotographic copying machine including a photoconductive imaging element, means for electrostatically charging said element, means for exposing the charged element to a light image formed by illumination of an original, thus forming a charge image composed of image portions and background areas, and means for developing the charge image including a developing device for applying electrically conductive marking particles to said element so that such particles are attracted to said image portions, said device comprising an electrode to apply a potential between it and said element, the improvement which comprises, in combination with a said developing device supplied with electrically conductive marking particles having a resistivity of less than $10^{13}$ ohm.cm, control means having first and second settings respectively for establishing different sets of conditions of said illumination and of a said potential which sets respectively will cause said image portions of a charge image of a high-contrast original to be developed with their background substantially free of said marking particles and will cause said image portions of a charge image of a low-contrast original to be developed with their background attracting said particles sufficiently to become grayish in tone, and means for generating an a.c. voltage having a frequency of between 1 and 7 kHz and a peak-to-peak amplitude of at least 50 volts, said control means including means operative in said second setting thereof but inoperative in said first setting thereof to apply said a.c. voltage between said electrode and said element, whereby homogeneity of said background tone is assured.

12. An electrophotographic copying machine according to claim 11 wherein said control means includes switching means for establishing said first and second settings, said switching means being operative in a first position thereof to cause said exposing means to form a light image effective to discharge said element sufficiently to keep said background areas substantially free of said marking particles, and being operative in a second position thereof to cause said exposing means to form a light image of reduced strength and to apply said a.c. voltage to said electrode.

13. An electrophotographic copying machine according to claim 11 and including means for applying to said electrode a d.c. voltage sufficient to counteract the charge of said charge image and means for superimposing said a.c. voltage on said d.c. voltage, said control means including switching means for establishing said first and second settings, said switching means being operative in a first position thereof to cause said exposing means to form a light image effective to discharge said element sufficiently to keep said background areas substantially free of said marking particles, and to activate said d.c. voltage applying means at a voltage suited for said image portions of the charge image of a high-contrast original, said switching means being operative in a second position thereof to cause said exposing means to form a light image of increased strength, and to activate said d.c. voltage applying means at a voltage suited for said image portions of the charge image of a low-contrast original, and to activate said a.c. voltage superimposing means.

* * * * *